United States Patent [19]

Yazu et al.

[11] Patent Number: 4,501,610

[45] Date of Patent: Feb. 26, 1985

[54] FINE PARTICLES OF FERROMAGNETIC METAL AND PROCESS FOR PRODUCING THE SAME

[75] Inventors: Kazumasa Yazu; Yasuto Adachi; Takayoshi Yoshizaki, all of Minamata, Japan

[73] Assignee: Chisso Corporation, Ohsaka, Japan

[21] Appl. No.: 582,709

[22] Filed: Feb. 23, 1984

[30] Foreign Application Priority Data

Feb. 23, 1983 [JP] Japan ..... 58-28987

[51] Int. Cl.[3] ..... H01F 1/06; H01F 1/33

[52] U.S. Cl. ..... 75/0.5 AA; 148/105

[58] Field of Search ..... 75/0.5 AA, 0.5 BA; 148/105

[56] References Cited

U.S. PATENT DOCUMENTS

| | | | |
|---|---|---|---|
| 4,069,073 | 1/1978 | Tadokoro et al. | 148/105 |
| 4,295,879 | 10/1981 | Steck et al. | 148/105 |
| 4,344,791 | 8/1982 | Steck et al. | 148/105 |
| 4,384,892 | 5/1983 | Suzuki et al. | 148/105 |

*Primary Examiner*—W. Stallard

*Attorney, Agent, or Firm*—Beall Law Offices

[57] ABSTRACT

Improved acicular fine particles of ferromagnetic metal having superior powder characteristics and tape characteristics are provided, which fine particles are prepared by adding to an aqueous suspension of acicular iron oxide or oxyhydroxide, a solution of a different kind and non-alkali metal salt of an organic acid in place of conventional inorganic acids, followed by making the mixture basic and heat reduction.

17 Claims, No Drawings

FINE PARTICLES OF FERROMAGNETIC METAL AND PROCESS FOR PRODUCING THE SAME

BACKGROUND OF THE INVENTION

1. Field of the Invention

This invention relates to acicular fine particles of ferromagnetic metal for magnetic recording and a process for producing the same.

2. Description of the Prior Art

In recent years, magnetic powder having a high coercive force and a high spontaneous magnetization has been required for high-performance cassette tapes for audio, compact video tapes, etc., and as a product meeting such requirements, fine particles of ferromagnetic metal have been noted which are obtained by subjecting powder composed mainly of iron oxide or oxyhydroxide (which powder will hereinafter be often referred to as "starting raw material") to heat reduction e.g. in a $H_2$ stream. In order to control the magnetic characteristics and the stability of oxidation resistance of the iron fine particles, a process has been proposed wherein one or more elements among a group of different elements (mainly metal elements) such as Ni, Co, Al, Si, etc. are adhered onto the starting raw material, followed by heat reduction to prepare fine particles of ferromagnetic metal. The process is concretely a process wherein an aqueous solution of a salt of the above different elements is added to an aqueous suspension of the above starting raw material, followed by changing the pH of the mixture to deposit and adhere the different elements in the form of hydroxide or the like onto the surface of the starting raw material, dehydrating and heat-reducing. In that process, inorganic salts such as chlorides, sulfates, etc. have so far been used as the above salt of the different elements. However, if chlorine ion, sulfuric acid ion or the like present in these inorganic salts remains on the surface of the particles after adhesion, it has a bad effect at the time of heat reduction step and makes the stability of oxidation resistance inferior. Thus, in order to remove them, particles after adhesion have so far been washed with water, but complete removal has been impossible that is, a considerable amount thereof usually remained on the surface of the material. Thus, various characteristics of the resulting fine particles of ferromagnetic metal was limited. The above bed effect which results at the time of heat reduction step refers concretely to sintering and tearing to pieces of the above particles, which will hereinafter be collectively referred to as collapse of particles. Such collapse reduces the uniformity of the particulate form and also produces inferior coercive force (Hc), and squareness (Rs), for powder characteristics, and inferior Hc and Rs for tape characteristics.

SUMMARY OF THE INVENTION

In view of the drawbacks of the above prior art, the gist of the present invention consists in using a metal salt of an organic acid as the salt of a metal to be adhered.

Namely the present invention resides in a process for producing acicular fine particles of ferromagnetic metal by adding a solution of a salt of a metal which is different from iron and exclusive of alkali metals (which metal will hereinafter be referred to as different metal), to an aqueous suspension of acicular iron oxide or iron oxyhydroxide and further adding a basic substance to make the resulting mixture basic and thereby deposit and adhere the hydroxide of the different metal onto the iron oxide or iron oxyhydroxide, followed by heat reduction, which process comprises using a metal salt of an organic acid as the above metal salt, and acicular fine particles of ferromagnetic metal thus obtained.

DETAILED DESCRIPTION OF THE INVENTION

As the iron oxide or iron oxyhydroxide used as the starting raw material in the present invention, materials composed mainly of other iron oxides. (e.g. $\alpha$-$Fe_2O_3$) or oxyhydroxides (e.g. $\gamma$-FeOOH) may also be used besides iron $\alpha$-oxyhydroxide so long as they have acicularity.

As the organic acid salt of a different metal usable in the present invention, metal salts of formic acid, acetic acid, lactic acid, stearic acid, oleic acid, naphthenic acid, benzoic acid or the like are illustrated. Preferably metal salts of organic carboxylic acids of 1 to 20 carbon atoms, more preferably those of 1 to 4 carbon atoms and most preferably metal acetate may be used.

The different kind metals of these metal salts have no particular limitation, and one or more kinds of metals in a broad range excluding iron and alkali metals may be used. Examples of usable metals are Mg, Al, Cr, Mn, Co, Ni, Cu, Zn, Pd, Ag, Cd, Pb, Ca, Sr, Ba, Ti, Mo, Sn, Bi, Nb, Sm etc. Further, it is possible to coprecipitate iron salts and the different kind metal salts in combination. The reason why alkali metals are excluded is that they dissolve in an aqueous solvent in large quantities and hardly deposit on iron $\alpha$-oxyhydroxide.

As the solvent for the above metal salts of organic acids, alcohols, esters, ketones, ethers or carboxylic acids of 1 to 4 carbon atoms or mixture thereof or mixtures thereof with water may be used besides water.

As the base used in the present invention, KOH, NaOH, aqueous $NH_3$, $NH_3$, gas, etc. are usable. In order to eliminate the effect of their cations remaining on the metal surface, aqueous $NH_3$ or $NH_3$ gas among the above bases may be preferable to use. This is because of the fact that ammonium iron is decomposed and separated at the time of heat reduction.

When the above bases are added, the pH of the above aqueous suspension of iron $\alpha$-oxyhydroxide or the like is desirable to be adjusted to 8.5 to 12.0, preferably 9.0 to 11.0. Further, if desired, the temperature of the system is raised to 60° C. or higher, preferably 80° C. or higher. By raising the temperature, it is possible to crystallize the metal hydroxide precipitated in the vicinity of room temperature in a gel-like state and thereby make the adhesion state firmer.

The proportion of the weight of the element to be adhered to that of the starting raw material is preferably in the range of 0.5 to 15% by weight, more preferably 1 to 10% by weight, for controlling various characteristics of the aimed particles, and making the saturation magnetization of the particles higher and the adhesion of the metal more uniform.

The above heat reduction is usually carried out with $H_2$ gas in the temperature range of 300° C. to 600° C.

According to the present invention, since metal salts of organic acids are used, the radicals of the organic acids are decomposed and separated; harmful anions do not remain on the surface of fine particles of ferromagnetic metal; thus collapse of the particles at the time of heat reduction is few; and hence it is possible to prepare fine particles of ferromagnetic metal having a good uniformity, an improved squareness at the time of making tapes therefrom and an improved stability of oxidation resistance. Further, if a metal salt of acetic acid is used at the time of the adhesion, the dispersibility of the slurry is improved due to acetic acid ions to effect a more uniform adhesion; hence it is possible to obtain fine particles of ferromagnetic metal having more uniform magnetic characteristics.

The present invention will be concretely described by way of Examples.

EXAMPLE 1

Iron α-oxyhydroxide (water content: 80%)(300 g) was placed in a vessel and water (1.5 l) was added, followed by stirring for 2 hours, dropwise adding acetic acid (2 ml) to the resulting slurry to make its pH 3.0, further stirring, dropwise adding an aqueous solution obtained by dissolving nickel acetate $Ni(OCOCH_3)_2 \cdot 4H_2O$)(5.36 g) as a metal salt in water (100 ml), further stirring, dropwise adding aqueous $NH_3$ to adjust the pH of the mixture to 9.5, stirring for 30 minutes, raising the temperature up to 90° C. or higher, keeping the state for one hour, cooling to the room temperature, dropwise adding an aqueous solution of silicic acid (Si:1.0%)(140 g) for imparting heat resistance and sintering resistance to the resulting particles, filtering off and drying the particles and reducing the thus prepared material in $H_2$ stream at 500° C., to obtain fine particles of ferromagnetic metal. The magnetic characteristics of the magnetic powder are shown in Table 1 and the magnetic characteristics and oxidation resistance at the time of making tapes from the powder are shown in Table 2.

EXAMPLE 2

Magnetic powder was obtained in the same manner as in Example 1 except that the metal salt solution used in Example 1 was replaced by a solution obtained by dissolving nickel acetate (13.39 g) in water (250 ml). Various characteristics of the powder are shown in Tables 1 and 2.

EXAMPLE 3

Magnetic powder was obtained in the same manner as in Example 1 except that the metal salt solution used in Example 1 was replaced by a solution obtained by dissolving nickel acetate (26.78 g) in water (500 ml). Various characteristics of the powder are shown in Tables 1 and 2.

EXAMPLE 4

Magnetic powder was obtained in the same manner as in Example 1 except that the metal salt solution used in Example 1 was replaced by a solution obtained by dissolving nickel acetate (40.17 g) in water (750 ml). Various characteristics of the powder are shown in Tables 1 and 2.

EXAMPLE 5

Magnetic powder was obtained in the same manner as in Example 1 except that the metal salt solution used in Example 1 was replaced by a solution obtained by dissolving cobalt acetate $(Co(OCOCH_3)_2 \cdot 4H_2O)$(5.34 g) in water (100 ml). Various characteristics of the powder are shown in Tables 1 and 2.

EXAMPLE 6

Magnetic powder was obtained in the same manner as in Example 1 except that the metal salt solution used in Example 1 was replaced by a solution obtained by dissolving copper acetate $(Cu(OCOCH_3)_2.H_2O)$(3.97 g) in water (100 ml). Various characteristics of the powder are shown in Tables 1 and 2.

EXAMPLE 7

Magnetic powder was obtained in the same manner as in Example 1 except that the metal salt solution used in Example 1 was replaced by solution obtained by dissolving zinc acetate $(Zn(OCOCH_3)_2 \cdot 2H_2O)$(4.25 g) in water (100 ml). Various characteristics of the powder are shown in Tables 1 and 2.

EXAMPLE 8

Magnetic powder was obtained in the same manner as in Example 1 except that the metal salt solution used in Example 1 was replaced by a solution obtained by dissolving nickel formate $(Ni(OCHO)_2 \cdot 2H_2O)$(3.98 g) in water (100 ml). Various characteristics of the powder are shown in Tables 1 and 2.

COMPARATIVE EXAMPLE 1

Magnetic powder was obtained in the same manner as in Example 1 except that the metal salt solution used in Example 1 was replaced by a solution obtained by dissolving nickel sulfate $(NiSO_4 \cdot 6H_2O)$(5.66 g) in water (100 ml). Various characteristics of the powder are shown in Tables 1 and 2.

COMPARATIVE EXAMPLE 2

Magnetic powder was obtained in the same manner as in Example 1 except that the metal salt solution used in Example 1 was replaced by a solution obtained by dissolving nickel chloride $(NiCl_2 \cdot 6H_2O)$(5.12 g) in water (100 ml). Various characteristics are shown in Tables 1 and 2.

COMPARATIVE EXAMPLE 3

Magnetic powder was obtained in the same manner as in Example 1 except that the metal salt solution was replaced by a solution obtained by dissolving cobalt sulfate $(CoSO_4 \cdot 7H_2O)$(6.03 g) in water (100 ml). Various characteristics of the powder are shown in Tables 1 and 2.

TABLE 1

| | Adhered substance, its amount adhered*1 | | B - H characteristics | | |
|---|---|---|---|---|---|
| | | (wt %) | Hc (Oe) | σs (emu/g)*2 | Rs*3 |
| Example | | | | | |
| 1 | $Ni(OCOCH_3)_2$ | 2.0 | 1510 | 163 | 0.51 |
| 2 | $Ni(OCOCH_3)_2$ | 4.9 | 1470 | 160 | 0.51 |
| 3 | $Ni(OCOCH_3)_2$ | 9.7 | 1350 | 154 | 0.49 |
| 4 | $Ni(OCOCH_3)_2$ | 14.5 | 1260 | 146 | 0.47 |
| 5 | $Co(OCOCH_3)_2$ | 2.0 | 1590 | 167 | 0.51 |
| 6 | $Cu(OCOCH_3)_2$ | 1.9 | 1440 | 153 | 0.50 |
| 7 | $Zn(OCOCH_3)_2$ | 1.9 | 1480 | 156 | 0.50 |
| 8 | $Ni(OCHO)_2$ | 2.0 | 1490 | 160 | 0.50 |
| Compar. ex. | | | | | |
| 1 | $NiSO_4$ | 2.0 | 1460 | 157 | 0.49 |
| 2 | $NiCl_2$ | 2.0 | 1470 | 158 | 0.49 |
| 3 | $CoSO_4$ | 2.0 | 1530 | 162 | 0.49 |

*1The "amount adhered" refers to the percentage by weight of a different kind metal component in the metal compound adhered. relative to iron α-oxyhydroxide.
*2σs: Specific magnetization
*3Rs: Squareness

TABLE 2

| | Adhered substance, its amount adhered | | Tape characteristics | | | | Oxidation resistance*6 |
|---|---|---|---|---|---|---|---|
| | | (wt %) | Hc(Oe) | Br(G)*4 | Rs | SFD*5 | (%) |
| Example | | | | | | | |
| 1 | $Ni(OCOCH_3)_2$ | 2.0 | 1440 | 2760 | 0.860 | 0.480 | 2.3 |
| 2 | $Ni(OCOCH_3)_2$ | 4.9 | 1390 | 2630 | 0.845 | 0.515 | 1.8 |
| 3 | $Ni(OCOCH_3)_2$ | 9.7 | 1250 | 2380 | 0.805 | 0.570 | 2.0 |
| 4 | $Ni(OCOCH_3)_2$ | 14.5 | 1150 | 2190 | 0.770 | 0.625 | 2.0 |
| 5 | $Co(OCOCH_3)_2$ | 2.0 | 1510 | 2820 | 0.850 | 0.485 | 2.6 |
| 6 | $Cu(OCOCH_3)_2$ | 1.9 | 1360 | 2540 | 0.835 | 0.510 | 2.0 |
| 7 | $Zn(OCOCH_3)_2$ | 1.9 | 1400 | 2580 | 0.840 | 0.490 | 2.7 |
| 8 | $Ni(OCHO)_2$ | 2.0 | 1420 | 2670 | 0.850 | 0.500 | 2.4 |
| Compar. ex. | | | | | | | |
| 1 | $NiSiO_4$ | 2.0 | 1360 | 2630 | 0.795 | 0.560 | 4.0 |
| 2 | $NiCl_2$ | 2.0 | 1370 | 2670 | 0.800 | 0.555 | 3.8 |
| 3 | $CoSO_4$ | 2.0 | 1430 | 2730 | 0.790 | 0.560 | 4.3 |

*4Br: Remanent induction
*5SFD: Switching field distribution
*6The "oxidation resistance" refers to the percentage Br reduction. The measurement conditions of oxidation resistance are as follows: 50° C. RH 90%, one week.

As apparent from comparison of the data of Example 1 with those of Comparative example 1–3 in Tables 1 and 2, the magnetic powder of the present invention has increased Hc and $\sigma s$ and improved Rs, SFD and oxidation resistance.

What we claim:

1. A process for producing fine acicular particles of ferromagnetic metal comprising:

providing an aqueous suspension of at least one of acicular iron oxide and acicular iron oxyhydroxide;

adding a solution of a salt of an organic acid and a non-alkali, non-ferrous metal hereinafter called different metal, to the aqueous suspension to adhere the different metal to the acicular iron; and subjecting the adhered acicular iron to a reduction process.

2. A process of claim 1 wherein said organic acid has 1 to 20 carbon atoms.

3. A process of claim 1 wherein said organic acid has 1 to 4 carbon atoms.

4. A process of claim 1 wherein said organic acid is acetic acid.

5. A process of claim 1, wherein said different kind metal is at least one member selected from the group consisting of Mg, Al, Cr, Mn, Co, Ni, Cu, Zn, Pd, Ag, Cd, Pb, Ca, Sr, Ba, Ti, Mo, Sn, Bi, Nb and Sm.

6. A process according to claim 1, wherein, before the reduction process, a base is added and the pH is adjusted to a range 8.5–12 and preferably 9.0–11.

7. A process according to claim 6, wherein the base is one of KOH, NaOH, aqueous $NH_3$ and $NH_3$ gas.

8. A process according to claim 7, wherein the base is one of aqueous $NH_3$ and $NH_3$ gas.

9. A process according to claim 1, wherein the salt solution includes at least one of alcohol, ester, ketone, ether, water and carboxylic acid of 1–4 carbon atoms.

10. A process according to claim 1, wherein the weight of the different metal adhered is in the range of 0.5 to 15% by weight of the acicular iron.

11. A process according to claim 1, wherein the reduction process is carried out with $H_2$ gas at a temperature of 300°–600° C.

12. Acicular fine particles of claim 6, wherein said organic acid has 1 to 20 carbon atoms.

13. Acicular fine particles of claim 6, wherein said organic acid has 1 to 4 carbon atoms.

14. Acicular fine particles of claim 6, wherein said organic acid is acetic acid.

15. Acicular fine particles of claim 6, wherein said different metal is at least one member selected from the group consisting of Mg, Al, Cr, Mn, Co, Ni, Cu, Zn, Pd, Ag, Cd, Pb, Ca, Sr, Ba, Ti, Mo, Sn, Bi, Nb and Sm.

16. Acicular fine particles of ferromagnetic metal produced according to the process comprising:

providing an aqueous suspension of at least one of acicular iron oxide and acicular iron oxyhydroxide;

adding a solution of a salt of an organic acid and a non-alkali, non-ferrous metal hereinafter called different metal, to the aqueous suspension to adhere the different metal to the acicular iron; and subjecting the adhered acicular iron to a reduction process.

17. A product according to claim 16, wherein the weight of the different metal adhered is in the range of 0.5 to 15% by weight of the acicular iron.

* * * * *